US009901837B2

(12) United States Patent
Henslee

(10) Patent No.: US 9,901,837 B2
(45) Date of Patent: Feb. 27, 2018

(54) BUCKET TIPPING APPARATUS

(71) Applicant: Willis Henslee, Modesto, CA (US)

(72) Inventor: Willis Henslee, Modesto, CA (US)

( * ) Notice: Subject to any disclaimer, the term of this patent is extended or adjusted under 35 U.S.C. 154(b) by 0 days.

(21) Appl. No.: 14/863,527

(22) Filed: Sep. 24, 2015

(65) Prior Publication Data

US 2016/0089611 A1 Mar. 31, 2016

Related U.S. Application Data

(60) Provisional application No. 62/055,237, filed on Sep. 25, 2014.

(51) Int. Cl.
*A63G 31/00* (2006.01)

(52) U.S. Cl.
CPC ..... *A63G 31/007* (2013.01)

(58) Field of Classification Search
CPC ..... A63G 31/007
See application file for complete search history.

(56) References Cited

U.S. PATENT DOCUMENTS

| | | | | |
|---|---|---|---|---|
| 5,820,471 | A * | 10/1998 | Briggs | A63B 9/00 472/117 |
| 6,651,268 | B1 | 11/2003 | Briggs | |
| 6,739,979 | B2 | 5/2004 | Tracy | |
| 7,572,191 | B2 | 8/2009 | Weston et al. | |
| 8,127,891 | B1 | 3/2012 | Gudinas, Jr. | |
| 2013/0119610 | A1* | 5/2013 | Legary | F41J 5/056 273/348 |

* cited by examiner

*Primary Examiner* — Michael Dennis
(74) *Attorney, Agent, or Firm* — Global Intellectual Property Agency, LLC; Daniel Enea

(57) ABSTRACT

A bucket tipping apparatus is provided. The bucket tipping apparatus includes a frame having an upper end and a lower end. The lower end of the frame includes at least one fastener thereon for removably securing the apparatus to a support surface, such as the ladder of a pool, among other supports. The upper end of the frame includes a receptacle pivotally affixed thereto, wherein the receptacle is suited for use in holding a volume of fluid. A fluid dispensing device having an elongated tube is secured to the frame and is configured to fill the receptacle with fluid. The receptacle is configured to support fluid therein until a tipping point, wherein the receptacle is actuated downwardly to dump the fluid and returned to a substantially upright position to repeat the process.

7 Claims, 3 Drawing Sheets

BUCKET TIPPING APPARATUS

CROSS REFERENCE TO RELATED APPLICATION

This application claims the benefit of U.S. Provisional Application No. 62/055,237 filed on Sep. 25, 2014. The above identified patent application is herein incorporated by reference in its entirety to provide continuity of disclosure.

FIELD OF THE INVENTION

The present invention relates to bucket tipping apparatuses. Specifically the present invention describes a bucket tipping apparatus wherein a receptacle is continuously filled with fluid until it reaches a tipping point, wherein the receptacle is then configured to actuate downwardly to dump the fluid before returning to a substantially upright position.

BACKGROUND OF THE INVENTION

Many people spend time outdoors at a pool in order to relax and cool off during periods of warm weather. Children in particular enjoy playing and swimming in pools. There are a variety of pool toys for children that can help them to develop their swimming skills, diving skills, and motor skills, while also having fun at the same time. These toys can include inflatable rafts, water slides, and water blasters, among many others.

However, children may easily become bored from simply swimming or playing in a pool and require new or additional toys to play with in the pool. Therefore, there exists a need for a tipping bucket apparatus that can be removably attached at a pool to provide amusement and enjoyment for children. The tipping bucket apparatus is particularly advantageous as it periodically dumps water in a waterfall effect, which stimulates children to create a multitude of games revolving around the tipping bucket apparatus.

Devices have been disclosed in the prior art that relate to pool toys, such as water squirting and water dumping devices. These include devices that have been patented and published in patent application publications. Some of these devices provide a pool ladder with a means for spraying water onto the feet of an individual. Other devices provide a plurality of poles that distribute water into a tipping bucket for pouring water onto the occupants of a pool. These devices, however, fail to provide a device attached to a pool ladder having a receptacle for dumping water onto individuals in a pool.

The present invention provides a bucket tipping apparatus configured to fill a receptacle and periodically dump water collected within the receptacle. The bucket tipping apparatus comprises a receptacle pivotally mounted to the upper end of a frame, wherein the frame can be secured to a support surface, such as the ladder of a pool. The receptacle is pivotally attached to each upper end via a spring-biased pivoting rod. A nozzle disposed above the receptacle is fluidly connected to a water pump via a hollow tube attached to the frame. The nozzle is configured to disperse fluid into the receptacle until the receptacle reaches a tipping point, wherein the receptacle is configured to tilt downwardly and dump the water before returning to the original position to repeat the process.

It is therefore submitted that the present invention is substantially divergent in design elements from the prior art, and consequently it is clear that there is a need in the art for an improvement to bucket tipping apparatuses. In this regard, the instant invention substantially fulfills these needs.

SUMMARY OF THE INVENTION

In view of the foregoing disadvantages inherent in the known types of bucket tipping apparatuses now present in the prior art, the present invention provides a bucket tipping apparatus that is configured to be removably attached to a support structure and configured to periodically dump fluid from a receptacle for people's amusement and enjoyment.

It is therefore an object of the invention to provide a new and improved bucket tipping apparatus that has all of the advantages of the prior art and none of the disadvantages.

Another object of the present invention is to provide a new and improved bucket tipping apparatus comprising a receptacle for collecting fluid that is pivotally connected to the upper end of a frame, wherein the frame is securable to a support surface, such as the ladder or edge of a pool.

Yet another object of the present invention is to provide a new and improved bucket tipping apparatus, wherein the receptacle is pivotally connected to the frame via a spring-biased pivoting rod.

Still yet another object of the present invention is to provide a new and improved bucket tipping apparatus, wherein a nozzle is disposed above the receptacle configured to be fluidly connected to a pump via a hollow tube removably secured to the frame for the purpose of filling the receptacle with fluid.

Yet a further object of the present invention is to provide a new and improved bucket tipping apparatus, wherein the receptacle is configured to receive and support fluid therein until a tipping point before dumping the fluid therefrom.

Another object of the present invention is to provide a new and improved bucket tipping apparatus, wherein the spring-biased pivoting rod is configured to allow the receptacle to actuate downwardly to a substantially horizontal orientation to dump fluid therefrom before returning to a substantially vertical orientation.

Still yet another object of the present invention is to provide a new and improved bucket apparatus wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
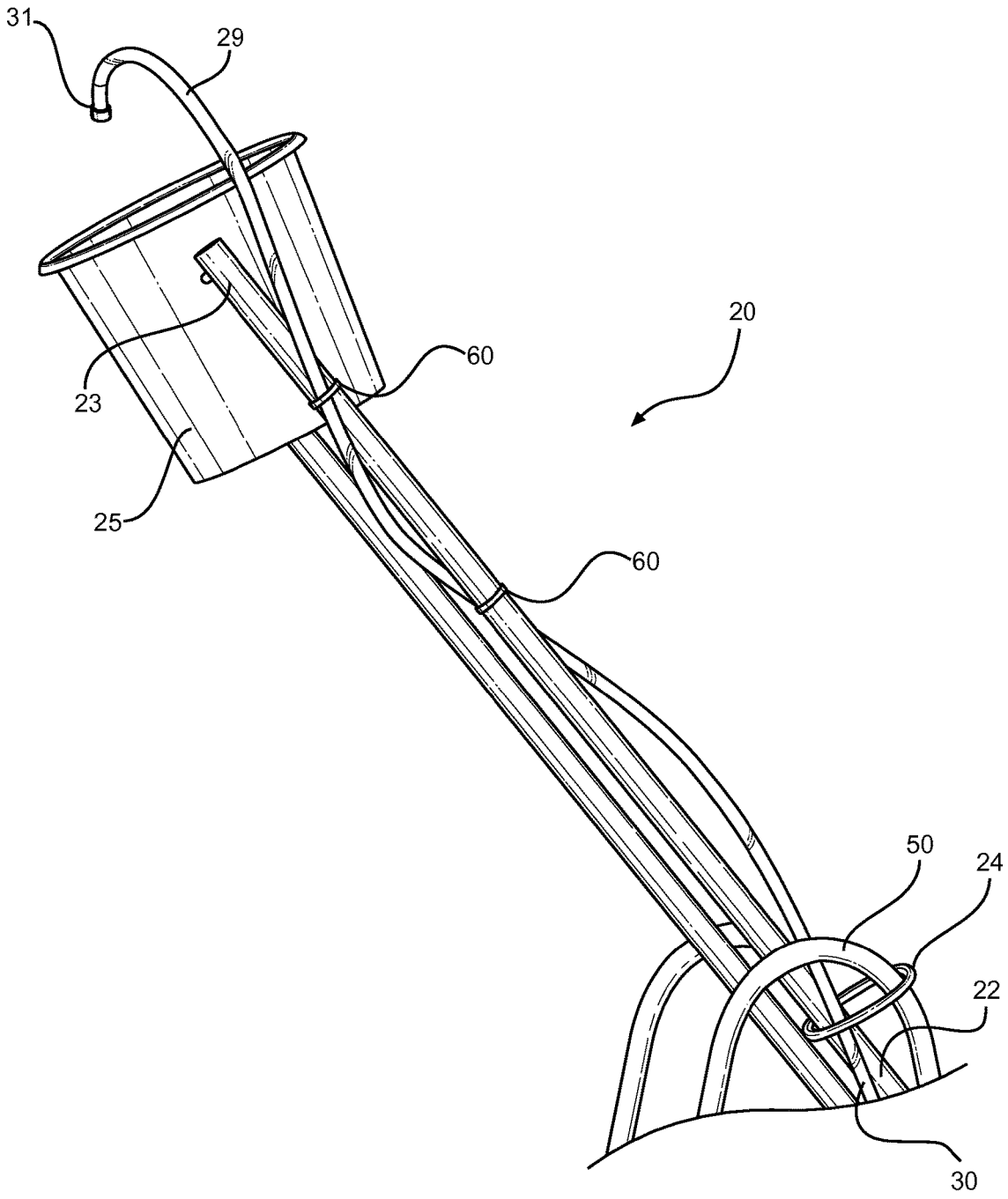
FIG. 1 shows a side perspective view of the bucket tipping apparatus.

Reference is made herein to the attached drawings. Like reference numerals are used throughout the drawings to depict like or similar elements of the bucket tipping apparatus. For the purposes of presenting a brief and clear description of the present invention, the preferred embodiment will be discussed as used for periodically dumping fluid for amusement and enjoyment. The figures are intended for representative purposes only and should not be considered to be limiting in any respect.

Figure 2:
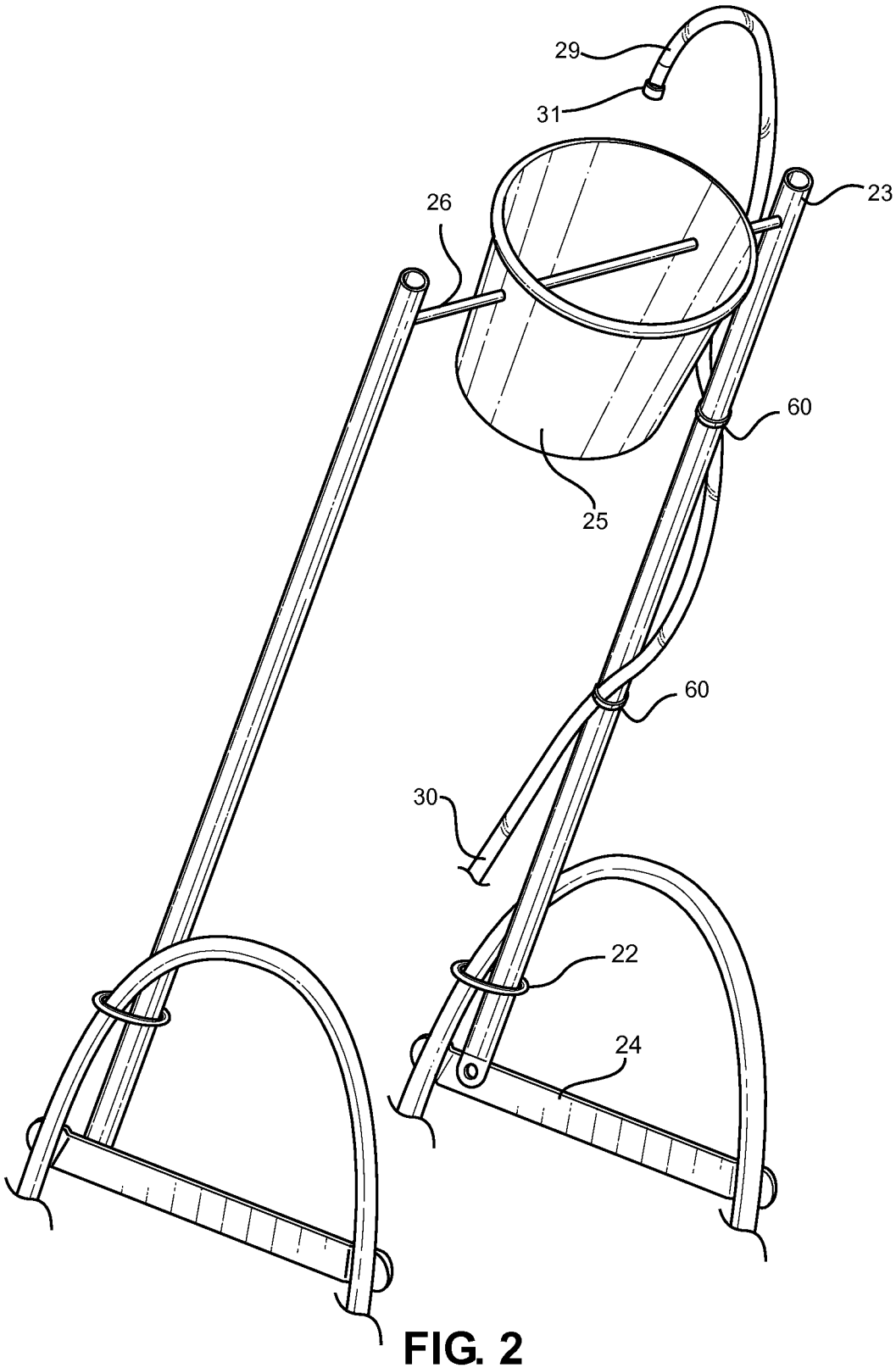
FIG. 2 shows a front perspective view of the bucket tipping apparatus.

Referring now to FIGS. 1 and 2, there are shown a side perspective and a front perspective of the bucket apparatus 20. The bucket apparatus 20 includes a frame 21 having an upper end 22 and a lower end 23. In the illustrated embodiment, the frame 21 comprises a pair of elongated rods that are aligned in a parallel manner to one another. However, in alternate embodiment, the frame 21 may have any of various other configurations. The frame is adapted to be disposed in an upright or inclined orientation.

The lower end 22 includes at least one fastener 24 thereon configured to allow the lower end 22 to be removably attached to a support structure 50. The support structure 50 may include a ladder for a pool as illustrated, a ledge of a pool, or other structures that may support the bucket tipping apparatus 20. The fastener 24 includes a threaded fastener, however it is readily apparent that those of ordinary skill in the art will envision a variety of other suitable fasteners that do not alter the spirit and scope of the inventive embodiments described herein. These alterations and variations are deemed within the scope of the present disclosure. In some embodiments, a fastener 61 is configured to removably fasten the frame 21 to the ladder in order to provide further support. In this way, each fastener 61, preferably a zip tie fastener, is configured to support the bucket apparatus 20 in a substantially upright orientation.

A receptacle 25 adapted to hold a volume of fluid therein is pivotally attached to the upper end 23 of the frame 21. Preferably, the receptacle 25 is pivotally secured via a spring-biased pivoting rod 26. The spring-biased pivoting rod 26 allows for the receptacle 25 to be actuated along a singular plane. The receptacle 25 is preferably substantially cylindrical in shape having an open upper end and a closed lower end forming an interior volume. The receptacle 25 is configured to receive and support fluid therein in a substantially vertical orientation until the receptacle 25 reaches a tipping point. The spring-biased pivoting rod 26 is configured to actuate the receptacle 25 into a substantially horizontal orientation when the receptacle 25 reaches the tipping point, and return the receptacle 25 into the substantially vertical orientation after dumping the fluids therein. In some embodiments, the spring-biased pivoting rod 26 is positioned on the receptacle 25 in an off-center manner, so that the receptacle 25 preferably tips or leans towards one side thereof. This helps to encourage tipping of the receptacle 25 once the receptacle 25 is filled.

An elongated tube 28 is removably secured to a portion of the frame 21 of the bucket tipping apparatus 20. The elongated tube 28 comprises a hollow interior volume through which fluid may flow. The elongated tube 28 is removably secured to the frame 21 via at least one fastener 60 disposed along the length of the frame 21. The fastener 60 includes a zip tie fastener, however other suitable fasteners are likewise contemplated. The elongated tube 28 includes an upper end 29 and a lower end 30, wherein the lower end 30 is fluidly connected to a pump. The pump is configured to force water through the lower end 30 and the elongated tube 28. The upper end 29 is disposed above of the receptacle 25 and includes a nozzle 31 that disperses fluid from the pump into the interior volume of the receptacle 25. In this way, the receptacle 25 is configured to support fluid therein until a tipping point, wherein the receptacle 25 rotates downwardly to dump the fluid and returns to a substantially vertical orientation to repeat the process.

Figure 3:
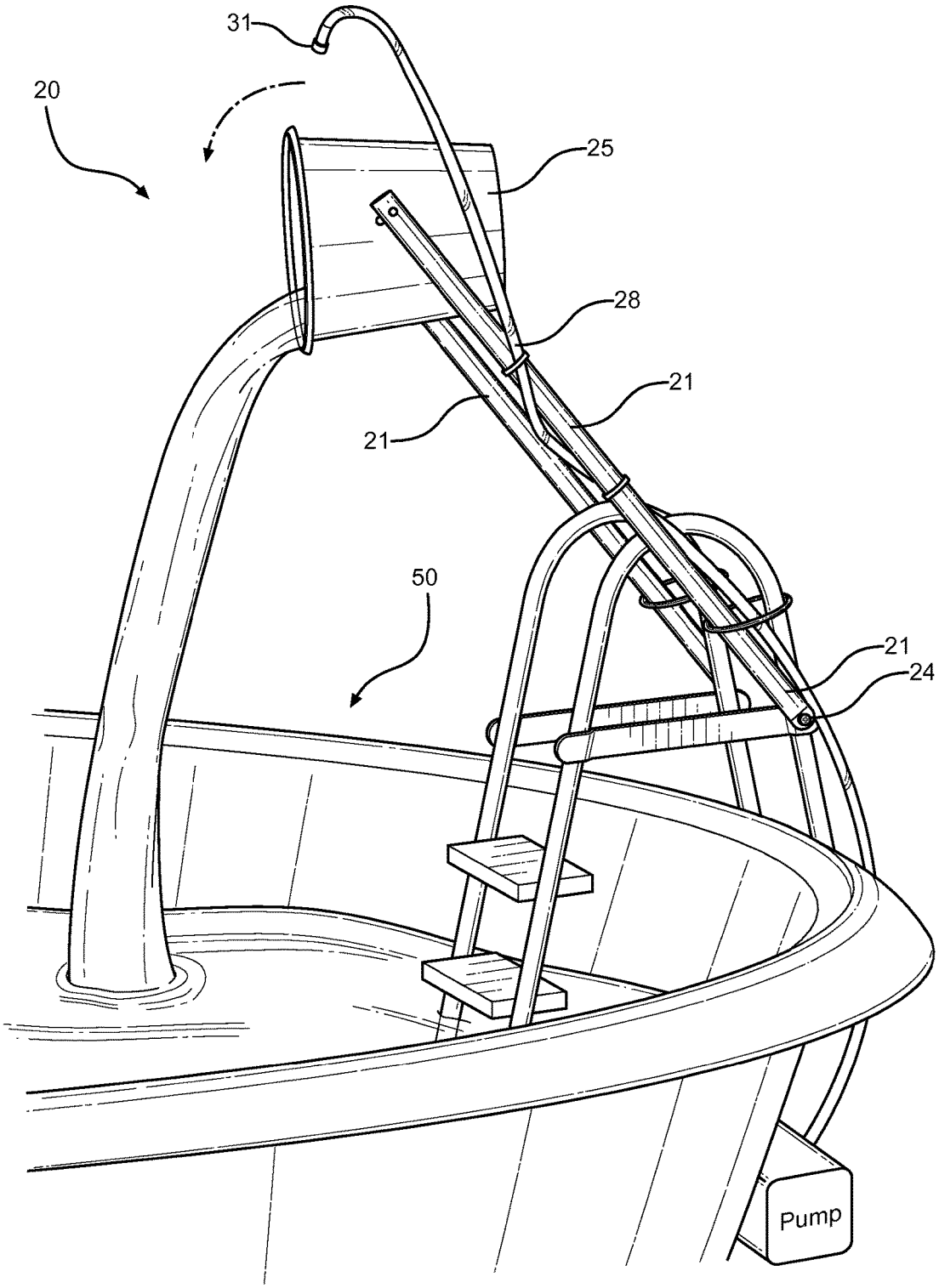
FIG. 3 shows a side perspective view of the bucket tipping apparatus as attached to a support structure for use.

Referring now to FIG. 3, there is shown a side perspective of the bucket tipping apparatus 20 disposed above a pool for use. The lower end of the frame 21 is removably secured to the ladder 51 of a pool, wherein the frame 21 extends upward therefrom so as to dispose the receptacle 25 on the upper end of the frame 21 at an increased elevation relative to the ladder. As illustrated, each first end 22 is removably attached to the ladder 51 via threaded fasteners. In this way, the second ends 23 of the frame 21 are situated above the pool 50. The second ends 23 are each pivotally attached to the receptacle 25 via the spring-biased pivot rod 26.

The receptacle 25 is configured to receive and support water dispersed from the nozzle 31 situated above the open end of the receptacle 25. The nozzle 31 is in fluid communication with a pump 52 via the elongated tube 28 that is attached along the length of the frame 21 and is configured to continuously disperse fluid when the pump 52 is activated. The elongated tube 28 is preferably composed of plastic, such as polycarbonate, however other suitable materials that are rigid enough to dispose the nozzle 31 above the receptacle 25 are contemplated.

The receptacle 25 is configured to actuate to a substantially horizontal orientation to dump the fluid supported therein into the pool 50 when it reaches the tipping point at which point the weight of the fluid in the receptacle 25 causes the receptacle 25 to tip. The spring-biased pivoting rod 26 is configured to return the receptacle 25 towards a substantially vertical orientation to repeat the dumping process.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bucket tipping apparatus, comprising:

a frame comprising a pair of parallel rods having an upper end and a lower end;

the pair of rods forming a gap, the gap configured to allow a user to pass therebetween;

a receptacle pivotally attached to said upper end of said frame via a spring-biased pivot rod;

wherein the pair of rods extend at an angle from a support surface such that the receptacle is vertically offset from the lower end;

the lower end pivotally affixed to the support surface;

at least one fastener removably affixed to the support surface and disposed on the lower end, the fastener configured to secure the angle of the pair of rods relative to the support surface;

an elongated tube adapted to be connected to a fluid pump, wherein said elongated tube is adapted to dispense fluid into said receptacle.

2. The bucket apparatus of claim 1, wherein said receptacle comprises a lower end, sidewalls, and an open upper end, defining an interior volume adapted to hold a volume of fluid therein.

3. The bucket apparatus of claim 1, wherein said tube of said elongated tube is affixed along a portion of said frame.

4. The bucket tipping apparatus of claim 1, wherein said elongated tube comprises a nozzle on an end thereof adapted to dispense fluid into said receptacle.

5. The bucket tipping apparatus of claim 1, wherein an upper end of said elongated tube is disposed adjacent to an open end of said receptacle.

6. The bucket tipping apparatus of claim 1, wherein said receptacle is adapted to tip once said receptacle has been filled with fluid so as to spill said fluid therefrom, and wherein said receptacle is adapted to return to an upright position once said fluid has been spilled.

7. The bucket tipping apparatus of claim 1, wherein the spring-biased pivot rod extends through the interior volume of the receptacle.

* * * * *